United States Patent [19]

Nakajima et al.

[11] Patent Number: 4,583,796

[45] Date of Patent: Apr. 22, 1986

[54] INSULATED DOOR

[75] Inventors: Noriaki Nakajima, Kyoto; Toshimasa Imaizumi; Kazuhiro Anzai, both of Osaka, all of Japan

[73] Assignee: Tokyo Shibaura Denki Kabushiki Kaisha, Kawasaki, Japan

[21] Appl. No.: 545,341

[22] Filed: Oct. 25, 1983

[30] Foreign Application Priority Data

Nov. 15, 1982 [JP] Japan ..... 57-173211[U]

[51] Int. Cl.[4] ..... F25D 11/00

[52] U.S. Cl. ..... 312/214; 49/478; 52/802; 52/823; 312/296

[58] Field of Search ..... 52/802, 803, 804, 805, 52/823, 825, 826; 49/478; 312/138 A, 296, 214

[56] References Cited

U.S. PATENT DOCUMENTS

| | | | |
|---|---|---|---|
| 1,056,072 | 3/1913 | Vogan | 312/214 X |
| 2,217,217 | 10/1940 | Engstrom | 52/805 X |
| 2,707,808 | 5/1955 | Anderson et al. | 52/805 X |
| 2,794,757 | 6/1957 | Bright | 52/823 X |
| 2,827,670 | 3/1958 | Schwindt | 52/826 X |
| 2,837,183 | 6/1958 | Heiman | 52/823 |
| 3,001,246 | 9/1961 | Mather | 52/823 |
| 3,056,475 | 10/1962 | Benham | 52/823 X |
| 3,070,852 | 1/1963 | Hilliker | 312/296 X |
| 3,182,767 | 5/1965 | Kuehl | 52/823 X |
| 3,786,613 | 1/1974 | Shepheard | 52/802 |
| 4,284,119 | 8/1981 | Martin et al. | 52/826 X |

FOREIGN PATENT DOCUMENTS

| | | | |
|---|---|---|---|
| 242718 | 2/1965 | Austria | 49/478 |
| 647020 | 8/1962 | Canada | 52/823 |
| 2448762 | 4/1975 | Fed. Rep. of Germany | 312/214 |
| 131289 | 6/1978 | Fed. Rep. of Germany | 312/214 |
| 2448616 | 10/1980 | France | 52/802 |
| 54-164961 | 11/1979 | Japan . | |
| 55-79783 | 6/1980 | Japan . | |
| 602629 | 5/1948 | United Kingdom | 312/296 |
| 838358 | 6/1960 | United Kingdom | 312/214 |
| 1226352 | 3/1971 | United Kingdom | 52/823 |

*Primary Examiner*—Francis K. Zugel
*Assistant Examiner*—Thomas A. Rendos
*Attorney, Agent, or Firm*—Cushman, Darby & Cushman

[57] ABSTRACT

The insulated door for refrigerators, freezers or similar cabinets where the inner and outer door surfaces are normally subjected to substantially different temperatures. This device has an outer panel with two sides formed by folding up two opposing edges out of its four edges. Two end sections fit on the other two opposing edges of the outer panel in such a way as to close off the above-mentioned two sides. An inner panel is disposed parallel to the outer panel so that its four edges are positioned inside the above-mentioned two sides and two end sections. Insulated material is packed between the said outer and inner panels. The end sections are provided with a first projecting rib and second projecting ribs which grip from both sides in the thickness direction, the edges of the inner panel which are positioned inside the end section. Either protruding or recessed interlocking parts are formed on the first or second ribs, and the corresponding other interlocking parts are formed on the ends of the inner panel. The inner panel and the two end sections are joined by fitting together the protruding and recessed interlocking parts.

18 Claims, 4 Drawing Figures

INSULATED DOOR

BACKGROUND OF THE INVENTION

This invention relates to insulated doors and, more particularly, to insulated doors having outer panels with folded sides.

Insulated doors for refrigerators, freezers of similar cabinets are typically formed from an outer panel of steel and an inner panel of plastic. The conventional method of construction has been to fold the four edges of the outer panel to form sides, screw the four edges of the inner panel to return flanges formed on these four edges, and pack the space between the inner and outer panels with insulating material.

Another insulated door is shown in U.S. Pat. No. 4,053,972. In this patent, the inner and outer panels together define a hollow enclosed chamber and into this chamber a foamed insulating material is placed, substantially filling the chamber and helping to interconnect the face and the drum.

However, a problem with conventional methods is that folding the four edges of the outer panel to form the four sides necessitates a press tool matching the size of the outer panel. Differences in the vertical dimension, even though the horizontal dimension might not vary, means that a special tool has to be provided for each size. This increases the cost of manufacture of the outer panel and hence of the insulated door.

SUMMARY OF THE INVENTION

The insulated door of the present invention has an outer panel with two sides formed by folding two opposing edges out of its four edges. Two end sections are provided which fit onto the other two opposing edges of the outer panel in such a way as to close off these two sides. An inner panel is disposed parallel to the outer panel so that its four edges are positioned inside the two folded sides and the two end sections. Insulation material is packed between the outer and inner panels.

The end sections include a first projecting rib and second projecting ribs which grip, from opposite sides in the thickness direction, the edges of the inner panel which are positioned inside the end sections either protruding or recessed interlocking parts are formed on the first or second ribs, and the corresponding other interlocking parts are formed on the ends of the inner panel. The inner panel and the two sections are joined by fitting together these protruding and recessed interlocking parts.

Thus, as long as one of the two dimensions (vertical/-horizontal) is the same, the same tool can be used for forming the folded sides even though the other dimension may vary. Thus, the useful range of the tool is increased and the cost of manufacture reduced.

DETAILED DESCRIPTION OF THE PREFERRED EMBODIMENT

Figure 1:
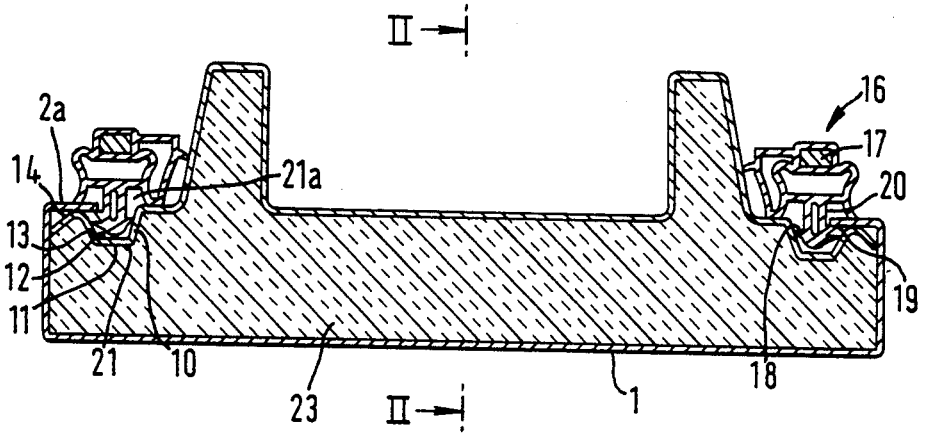
FIG. 1 is a section of an insulated door of the present invention.
Figure 2:
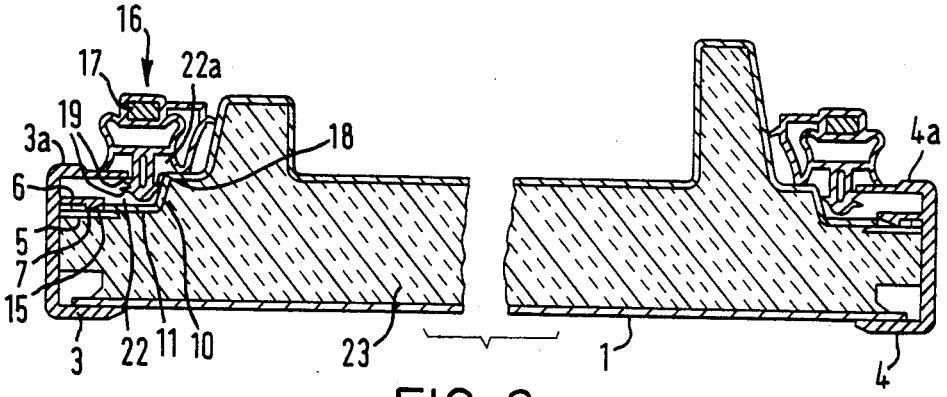
FIG. 2 is a section along the line II—II in FIG. 1.
Figure 3:
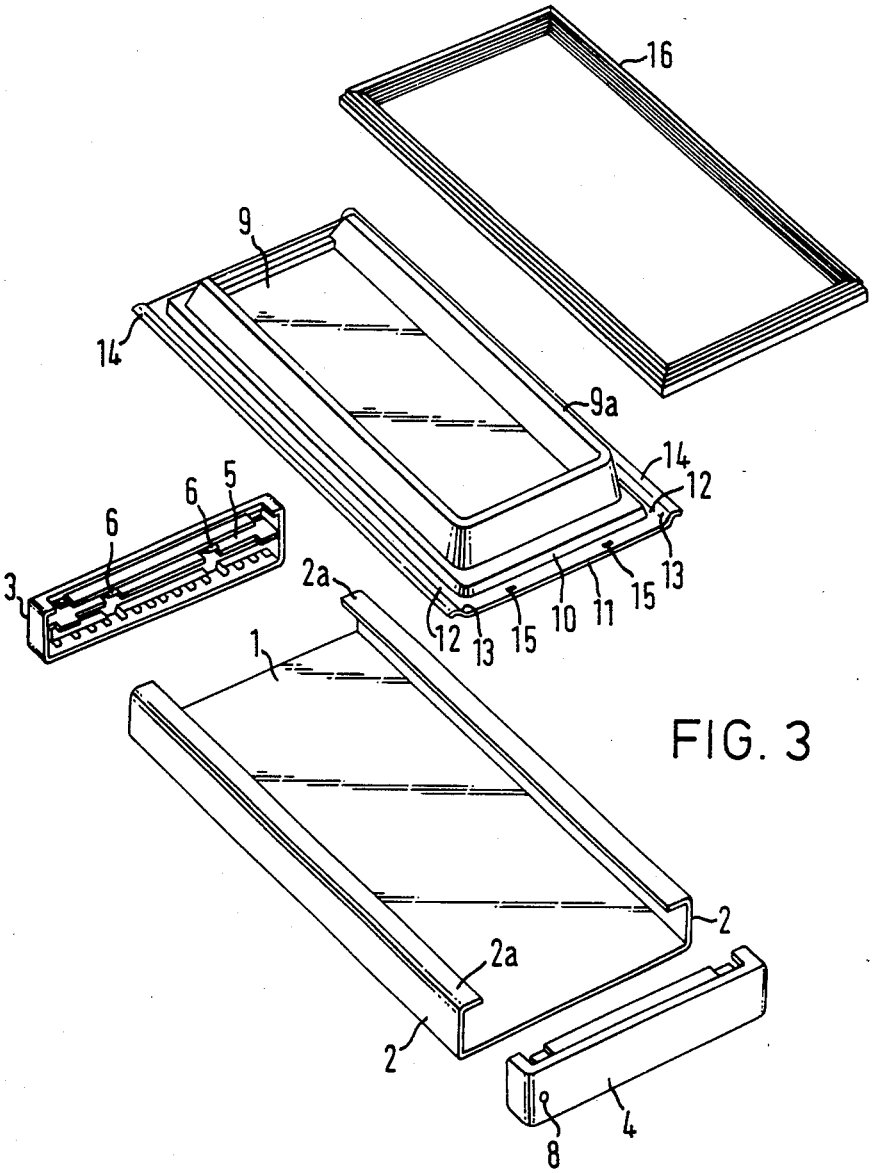
FIG. 3 is an oblique detailed assembly drawing.

In FIGS. 1–3, outer panel 1, e.g. of colored sheet steel, as two opposing lengthwise edges folded by a press tool (not illustrated) into a shape having a "C" cross-section to form two sides 2. Each of sides 2 has a return flange 2*a* formed by folding the extreme edge inwards. End sections 3 and 4 are made of plastic, each being shaped like a long narrow rectangular trough open on one side.

Figure 4:
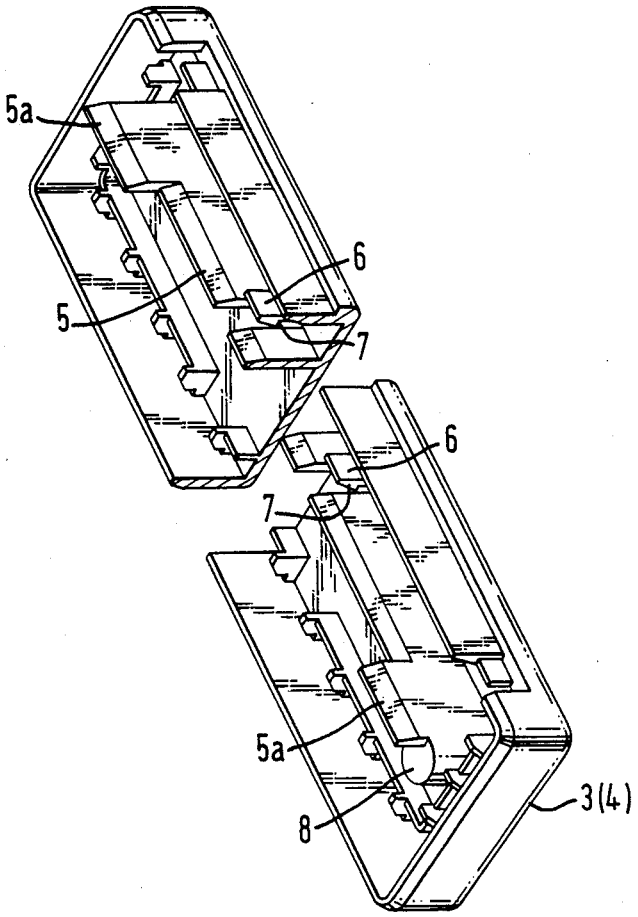
FIG. 4 is an oblique enlarged plan of an end section with a section removed.

As illustrated in FIG. 4, a first rib 5 is integrally molded along the inside length of each end section (from top to bottom in the drawing), while second ribs 6 are integrally molded, at intervals, a little above this first rib 5 in the drawing. Each of ribs 6 has a claw 7 projecting downwards in the drawing.

At each end of first rib 5 are extensions forming guide parts 5*a* with a bevelled face. Blind circular socket 8 is formed integrally in end sections 3 and 4 to take the hinge pins.

Plastic inner planel 9 has projecting part 9*a* to form pockets for bottles, etc. The four edges of inner panel 9 extend via a downward sloping section 10 to a flange 11. At two opposing edges, flange 11 is provided with an upward sloping section 13 forming a channel section 12 between it and downward sloping section 10. The extreme edge of upward sloping section 13 extends outwards to form a press-contact strip 14.

Engaging holes 15 (recessed interlocking parts) are formed, at intervals, on the edges of flange 11 on the lengthwise ends at positions corresponding to claws 7 of second ribs 6. Gasket 16 is fitted with an internal magnet 17, and has a hollow, integrally molded projected retaining part 20 with fins 18 and 19 at its tip.

An explanation follows of the steps in the assembly of an insulated door from the member constructed as described above.

First, end section 3 is fitted to one of the unfolded edges (i.e. the length direction in the exemplary embodiment) of outer panel 1, closing off the space between sides 2. Next, inner panel 9 is inserted from the as yet unclosed end of outer panel 1 along the length of outer panel 1.

Then flange 11 of the inserted end of inner panel 9 is placed on guides 5*a* of first rib 5 of end section 3 and pushed into end section 3. When this is done, the flange at this end is forced between first rib 5 and second ribs 6, and claws 7 of second ribs 6 snap into engagement with engaging holes 15 in flange 11.

Next, the end section 4 is fitted to the other edge (lengthwise direction in the exemplary embodiment) of outer panel 1, closing off the space between sides 2.

Then, in the same manner as already described, flange 11 at the other end is caught between the first and second ribs 5 and 6 of end section 4 so that outer panel 1, end sections 3 and 4 and inner panel 9 are all fastened together. In this assembled state, press-contact strip 14 of inner panel 9 is in contact over its whole length with return flanges 2*a*, which in turn face along channel sections 12 of inner panel 9 and partially close it off from the outside. Return flange 2*a* of outer panel 1 together with long channel section 12 of inner panel 9 define a retaining slot 21 in which the width of aperture 21*a* is narrower than the width of the bottom of slot 21.

Side walls 3*a* and 4*a* of end sections 3 and 4 face flange 11 at both ends of inner panel 9 with a controlled gap between them and flange 11. Thus, walls 3*a* and 4*a* of end sections 3 and 4 together with downward sloping section 10 and flange 11 of inner panel 9 define a retaining slot 22 in which the width of the aperture 22*a* is narrower than the width at the bottom of slot 22. Projection retaining part 20 of gasket 16 is pushed into retaining slots 21 and 22. When this is done, retaining fins 18 and 19 on projecting parts 20 make contact, in retaining slot 21 with downward sloping section 10 and return flange 2*a*, and, in retaining slot 22 with downward sloping section 10 and side walls 3*a* and 4*a* of end sections 3 and 4. As a result, gasket 16 is snapped into position along all four edges of inner panel 9. After gasket 16 has been fixed in this manner, the space between outer panel 1 and inner panel 9 is filled with insulating material 23 such as foamed urethane.

It will be appreciated by those skilled in the art that modifications within the scope of this invention are possible in the preferred exemplary embodiment described. For example, claws 7 may also be formed on first rib 5 or on inner panel 9 and engaging holes 15 may be formed on first rib 5 or on second ribs 6. In other respects also, this device is not limited to the embodiment described above, and variations may be effected provided there is no departure from the main principles of the device.

Since as the above explanation will have made clear only two opposing edges out of the four edges of the outer panel are folded to form sides, the size of the press tool to form the outer panel may be made to match the length of the longest side to be folded of the different outer panels being manufactured. Thus, the same press tool may be employed to fold many different outer panels as long as the unfolded dimension is the same.

Consequently, the useful range of the press tool can be increased, and the cost of manufacture of outer panels (and therefore of insulated doors) reduced.

Further, because two opposing edges of the inner panel are gripped between the first and second ribs, the inner panel can be held with a controlled gap between it and the outer panel, and this gap remains unaltered even when the inner panel is subjected to the foaming pressure of the insulating material.

Moreover, since either a protruding or recessed parts are formed on either the first or second ribs in the end sections, and the other of the two kinds of interlocking parts is formed on the inner panel, and the end sections and the inner panel are fastened together by the interlocking of the protruding and recessed parts, the outer panel, two end sections and inner panel are thus all fastened together. The outer panel, formed from colored steel, need not be subsequently painted. Unlike the case where holes to form the recessed interlocking parts are pierced in the outer panel and protruding interlocking parts formed in the end sections are made to engage in these holes, no necessity arises for rust-prevention treatment of such holes in the outer panel, and productivity is thereby improved.

While the article herein described constitutes preferred embodiments of the invention, it is to be understood that the invention is not limited to this precise article, and that changes may be made therein without departing from the scope of the invention as defined by the following claims.

What is claimed is:

1. An insulated door comprising:

an outer panel including first and second edges opposing one another and third and fourth edges opposing one another, said first and second edges folded to form first and second sides, respectively, said first and second sides each including a portion extending from said outer panel, said first and second sides further including first and second return flanges, respectively, extending from said extending portions, said first and second return flanges each defining an inner surface facing and spaced a preset distance from said outer panel;

first and second end sections fitted to the third and fourth opposing edges of the outer panel;

an inner panel placed in relation to the outer panel so that first and second opposing inner panel edges are positioned inside the first and second sides of the outer panel in contact with said return flange inner surfaces and third and fourth opposing inner panel edges are positioned within the first and second end sections, said inner and outer panels defining a main cavity therebetween, said inner panel including means defining a first arcuate lip in proximity to said inner panel first edge, an outer surface of said first lip contacting said first return flange inner surface along a first contact line, a first subsidiary cavity in communication with said main cavity being defined by the arcuate inner surface of said lip on the side of said first lip opposite said first contact line;

plural sets of first and second projection rib means, at least one set disposed in each of the end sections, for gripping the third and fourth edges of the inner panel which are positioned inside the end sections, said first and second rib means opposing one another and gripping an inner panel edge from opposite sides of said inner panel; and insulating material disposed within said main cavity and said first subsidiary cavity.

2. An insulated door according to claim 1, wherein the first and second projection rib means includes protruding and recessed interlocking parts, one of the protruding and recessed interlocking parts being formed on one of the first and second projection rib means, the other of the protruding and recessed interlocking parts being formed on an edge of the inner panel, the end sections and inner panel being fastened together by the engagement of the protruding and recessed interlocking parts.

3. An insulated door according to claim 2, wherein:

the interlocking part formed on the rib means includes a claw; and the interlocking part formed on the edge of the inner panel includes means defining a recess.

4. The insulated door according to claim 1, wherein the outer panel comprises colored steel sheet.

5. The insulated door according to claim 1, wherein the two end sections are made of plastic.

6. The insulated door according to claim 1, wherein:

the first and second opposing edges of said outer panel are each of a first predetermined length greater than the length of the third and fourth opposing edges thereof; and the two end sections are fitted to the shorter two opposing edges of the outer panel.

7. The insulated door according to claim 1, wherein each of the two end sections includes means for receiving a hinge pin.

8. An insulated door as in claim 1 wherein:

said inner panel includes means defining first and second channels substantially parallel and in proximity to said first and second edges thereof, respectively;

said first arcuate lip is disposed between said first channel and said inner panel first edge;

said inner panel further includes means defining a second arcuate lip in proximity to said inner panel second edge and disposed between said second channel and said inner panel second edge, an outer surface of said second lip contacting the inner surface of said second return flange along a second contact line, a second subsidiary cavity in communication with said main cavity defined within the arcuate inner surface of said second lip on the side of said second lip opposite said second contact line; and said insulating material is also disposed within said second subsidiary cavity.

9. A door as in claim 8 wherein:

said first lip extends along the entire length of said first edge parallel to said first edge and the upper portion thereof contacts said first return flange inner surface along said first contact line extending along the entire length of said first return flange; and said second lip extends along the entire length of said second edge parallel to said second edge and the upper portion thereof contacts said second return flange inner surface along said second contact line extending along the entire length of said second return flange.

10. A door as in claim 8 wherein said first and second lips terminate in said inner panel first and second edges, respectively, said inner panel first edge contacting one of said outer panel extending portions, said inner panel second edge contacting the other outer panel extending portion.

11. A door as in claim 8 wherein:

an edge of said first return flange and a wall of said first channel together define a first retaining slot therebetween;

an edge of said second return flange and a wall of said second channel together define a second retaining slot therebetween; and said door further includes resilient gasket means for sealing said door to another structure, said gasket means including retaining means for engaging with said first and second retaining slots.

12. A door as in claim 11 wherein:

the opening defined between said first return flange edge and the wall of said first channel has a dimension in the plane of said inner panel which is less than the dimension of said first channel at the bottom thereof;

the opening defined between said second return flange edge and the wall of said second channel has a dimension in the plane of said inner panel which is less than the dimension of said second channel at the bottom thereof; and said retaining means includes means defining a fin, said fin engaging with the first return flange edge and the second return flange edge when said retaining means is inserted into said first and second retaining slots, respectively.

13. A door as in claim 11 wherein:

said first and second end sections each include means defining an extending portion overhanging said inner panel;

said inner panel further includes means defining a first downward sloping section terminating in said third edge thereof and means defining a second downward sloping section terminating in said fourth edge thereof;

said first end section extending portion and said first downward sloping section together define a third retaining slot therebetween;

said second end section extending portion and said second downward sloping section together define a fourth retaining slot therebetween; and said retaining means also engages with said third and fourth retaining slots.

14. A door as in claim 13 wherein:

the opening defined between said first end section extending portion and said first downward sloping section has a dimension in the plane of said first end section extending portion which is less than the dimension of said third retaining slot at the bottom thereof;

the opening defined between said second end section extending portion and said second downward sloping section has a dimension in the plane of said second end section extending portion which is less than the dimension of the fourth retaining slot at the bottom thereof; and said fin of said retaining means also engages with the first and second end section extending portions when said retaining means is inserted into said third and fourth retaining slots, respectively.

15. A door as in claim 1 wherein:

said first and second end sections each include means defining an extending portion overhanging said inner panel;

said inner panel further includes means defining a first downward sloping section terminating in said third edge thereof and means defining a second downward sloping section terminating in said fourth edge thereof;

said first end section extending portion and said first downward sloping section together define a first retaining slot therebetween;

said second end section extending portion and said second downward sloping section together define a second retaining slot therebetween; and said door further includes resilient gasket means for sealing said door to another structure, said gasket means including retaining means for engaging with said third and fourth retaining slots.

16. A door as in claim 15 wherein:

the opening defined between said first end section extending portion and said first downward sloping section has a dimension in the plane of said first end section extending portion which is less than the dimension of said third retaining slot at the bottom thereof;

the opening defined between said second end section retaining portion and said second downward sloping section has a dimension in the plane of said second end section extending portion which is less than the dimension of the fourth retaining slot at the bottom thereof; and said retaining means includes means defining a fin, said fin engaging with the first and second end section extending portions when said retaining means is inserted into said third and fourth retaining slots, respectively.

17. A door as in claim 1 wherein:

said first lip terminates in said inner panel first edge;

said inner panel first edge contacts an inner surface of said first side outer panel extending portion; and a first empty cavity not in communication with said main cavity is defined between said first side and the portion of the first lip outer surface disposed between said inner panel first edge and said first contact line.

18. A door as in claim 1 wherein:

said outer panel first and second side extending portions are each perpendicular to said outer panel; and said first and second retaining flanges extend perpendicular to said first and second side extending portions, respectively, and substantially parallel to an overhanging said outer panel.

* * * * *